US008720327B2

(12) United States Patent
Eaves

(10) Patent No.: US 8,720,327 B2
(45) Date of Patent: May 13, 2014

(54) DEVICE AND METHOD FOR SEPARATING LAUNDRY ITEMS

(75) Inventor: Damien Eaves, Sydney (AU)

(73) Assignee: Jensen GmbH, Harsum (DE)

( * ) Notice: Subject to any disclaimer, the term of this patent is extended or adjusted under 35 U.S.C. 154(b) by 728 days.

(21) Appl. No.: 12/673,498

(22) PCT Filed: Jul. 4, 2008

(86) PCT No.: PCT/EP2008/058671

§ 371 (c)(1),
(2), (4) Date: Jun. 29, 2010

(87) PCT Pub. No.: WO2009/007318

PCT Pub. Date: Jan. 15, 2009

(65) Prior Publication Data

US 2010/0275793 A1 Nov. 4, 2010

(30) Foreign Application Priority Data

Jul. 6, 2007 (DE) ..... 10 2007 031 502

(51) Int. Cl.

| | |
|---|---|
| ***B30B 13/00*** | (2006.01) |
| ***B30B 9/00*** | (2006.01) |
| ***D06F 47/00*** | (2006.01) |
| ***D06F 95/00*** | (2006.01) |

(52) U.S. Cl.

CPC ..... *D06F 47/00* (2013.01); *D06F 95/00* (2013.01)

USPC ..... 100/35; 100/90; 100/264; 414/13; 198/804

(58) Field of Classification Search

USPC ..... 100/49, 181, 182, 184, 188 R, 264, 35, 100/90; 241/266; 68/112; 198/426, 468.01, 198/468.9, 804; 414/13

See application file for complete search history.

(56) References Cited

U.S. PATENT DOCUMENTS

| | | | | |
|---|---|---|---|---|
| 2,575,672 | A * | 11/1951 | Miller | 100/35 |
| 3,092,263 | A * | 6/1963 | Beaudry et al. | 414/13 |
| 3,841,140 | A * | 10/1974 | Hryc | 72/441 |
| 3,992,905 | A | 11/1976 | Oberley et al. | |
| 4,306,495 | A * | 12/1981 | Grantham | 100/37 |
| 4,943,198 | A * | 7/1990 | McCabe | 414/13 |
| 5,377,819 | A * | 1/1995 | Horton et al. | 198/853 |
| 6,287,066 | B1 * | 9/2001 | Heinz et al. | 414/13 |
| 6,666,393 | B2 * | 12/2003 | Weir | 241/30 |
| 2003/0111321 | A1 | 6/2003 | Van Oss | |
| 2003/0234357 | A1 * | 12/2003 | Nakashige et al. | 250/288 |
| 2007/0240584 | A1 * | 10/2007 | Lucas | 100/161 |

FOREIGN PATENT DOCUMENTS

| | | | |
|---|---|---|---|
| DE | 1154064 | B | 9/1963 |
| DE | 1928048 | A1 | 12/1970 |
| DE | 3220141 | A1 | 12/1983 |
| DE | 202004003814 | U1 | 5/2004 |
| EP | 0051721 | A | 5/1982 |

* cited by examiner

*Primary Examiner* — Jimmy T Nguyen
(74) *Attorney, Agent, or Firm* — Baker & Hostetler LLP

(57) ABSTRACT

A device for untangling pieces of laundry, in particular flat pieces of laundry, is provided. The device is integrated into a processing system that includes a washing system, a press and a conveying system. The mass of laundry is delivered from the press, is conveyed through a rack-like housing, and is untangled. The laundry is then transferred to a transverse conveyor belt in separated form.

28 Claims, 5 Drawing Sheets

DEVICE AND METHOD FOR SEPARATING LAUNDRY ITEMS

CROSS-REFERENCE TO RELATED APPLICATIONS

This application is a National Stage of International patent application PCT/EP2008/058671, filed on Jul. 4, 2008, which claims priority to foreign patent application DE 10 2007 031 502.5, filed on Jul. 6, 2007.

FIELD OF THE INVENTION

The invention relates to a device as well as to a method for untangling pieces of laundry, in particular flat pieces of laundry, which are supplied in the form of a compact mass from a press connected downstream from a washing machine.

BACKGROUND OF THE INVENTION

In large-scale laundries, the laundry is typically washed in a washing system, wherein provision is made at the end of the washing system for a press, in which the liquid in the laundry is wrung out. A so-called mass of laundry, which is supplied to further processing machines via conveying devices, is created in the press. The pieces of laundry do not come out of the washing machine in single pieces, but are twisted together to some extent due to the washing operation and are in this state shaped to form a compact mass in the press and are pressed together. Prior to the further processing operation, e.g. in mangles or finishers, the mass of laundry must be untangled, so that the pieces can be removed easily. It is problematic when the pieces of laundry must be separated by hand, because physical force must be mustered up and the pieces of laundry could possibly be damaged in response to improper handling.

Driers and shakers are known for untangling pieces of laundry coming out of the press, in the case of which the laundry is placed into a rotatable drum and, if applicable, hot air is applied to it, so that the laundry is untangled and is pre-dried to a predetermined residual moisture content, if applicable. However, due to their construction, the production of such devices is extensive and thus expensive and requires a correspondingly large space.

SUMMARY OF THE INVENTION

The invention is thus based on the object of creating a simple robust device for untangling and partially for separating pressed pieces of laundry as well as a corresponding method, in particular for untangling and for separating pressed flat pieces of laundry, such as bedding, table linen and the like, which are far superior to the common untangling devices and methods with regard to their construction as well as in their economic application.

This object is solved according to the invention in that the device encompasses a housing, which accommodates the mass of laundry comprising a corresponding conveying device, as well as a deforming device, which acts on the mass of laundry, and an output device, which partially separates the pieces of laundry of the mass of laundry.

The method according to the invention is characterized in that the mass of laundry is untangled by repeated lateral pressing and is moved along a device, which gradually reduces the height of the mass of laundry and in that the partially separated pieces of laundry are placed onto a further conveying device. Further advantageous features result from the corresponding dependent claims.

The housing, which accommodates the mass of laundry, is advantageously formed by a rack, which encompasses an open supply side and an open discharge side and the bottom of which is formed by a conveying device, in particular by a conveyor belt.

This bottom can be supported so as to be capable of being lowered or lifted in an advantageous manner, so as to be capable of accommodating masses of laundry of different heights. It is also possible for the housing to be capable of being lowered or lifted opposite to the bottom. Advantageously, the height measurements of the mass of laundry pulling in takes place by means of sensors, the signals of which are transmitted to a corresponding control device. This control device then prompts an adaptation of the device by lowering and/or lifting the conveyor belt and/or the housing.

According to a further advantageous feature of the invention, the housing sides arranged in longitudinal direction of the conveyor belt can be formed by plate elements or the like. Advantageously, these plate elements form the deforming device and can advantageously be moved in particular at right angles to the conveying device of the conveyor belt. They can thereby be embodied as shifting elements, which can be actuated by means of a pressure medium, wherein the pressure media can be formed by pressure medium cylinders, e.g. hydraulic cylinders or pneumatic cylinders, which can in particular be moved in two speed levels and wherein the control can be carried out by means of flow control valves, which are controlled by a suitable control device.

The device according to the invention can be integrated in an advantageous manner into a conveyor belt system, which connects to the press, so that the mass of laundry delivered from the press is untangled by means of the device according to the invention and the pieces of laundry of the mass of laundry are partially separated and are finally output to a further conveyor belt for further processing by means of the conveyor belt of the device according to the invention.

According to the invention, the output device arranged on the open discharge side of the housing encompasses a sley, which extends at least across the entire width of the mass of laundry and which can be moved into the trajectory of the mass of laundry. The sley can thereby be supported on the rack of the housing so as to be capable of being pivoted and can be actuated by means of a pressure medium. The pressure media can advantageously be formed from pressure medium cylinders, which are equipped with a pressure medium delimiter, so that the mass of laundry can be prevented from being stressed with an excessive compressive force and for pieces of laundry from being damaged thereby, if applicable.

Advantageously, provision can furthermore be made in conveying direction upstream of the sley for a stripping device, which extends across the entire housing width and underneath which the mass of laundry is conveyed, so that the upper part of the untangled mass of laundry is pressed backwards opposite to the conveying direction and the pieces of laundry are thereby partially untangled. Advantageously, the activation of the conveying device and of the pressure medium devices is coordinated and is program controlled. The conveyor belt can be moved gradually in forwards and backwards direction, so that the mass of laundry can be positioned opposite to the lateral plate elements. Advantageously, the conveyor belt thereby encompasses a surface comprising a high coefficient of friction, because the mass of laundry is transported underneath the stripping device and the sley, which is pivoted into the mass of laundry, and because the mass of laundry must be prevented from slipping along on the surface of the conveyor belt. In particular, the conveyor belt can be roughened on its surface and/or can encompass a contoured surface. For controlling the device according to the invention it is necessary for motion sensors to be provided in particular at the open supply side and at the open discharge side of the housing. These can be formed, e.g., by light barriers or photo cells or the like or provision can also be made for load sensors, e.g., to detect the loading of the conveyor belt with a mass of laundry.

In the event that the mass of laundry is introduced into the device according to the invention by the conveyor belt, which is connected to the press, or directly, the mass of laundry is initially positioned opposite to the lateral plate elements in such a manner that the lateral plate elements initially act on the front part of the mass of laundry, for example, in that they press it together and thus partially untangle the mass of laundry. By means of a further forward motion of the conveyor belt opposite to the plate elements, the mass of laundry can then be positioned in such a manner that the plate elements act on the center or rear part of the mass of laundry, respectively, for example, so as to also untangle this part. By gradually moving the conveyor belt backwards or forwards, respectively, this operation can be carried out several times until a desired untangling degree has been reached. The height expansion of the mass of laundry thereby increases upwards. The pressing speeds of the plate elements can thereby also be varied, so that they act slowly and evenly or rapidly and impulsively on the mass of laundry, wherein this can also take place several times in a pulsed manner. After the lateral impact on the mass of laundry, the mass of laundry is further conveyed to the output side of the device according to the invention, wherein a stripping device acts on the upper side of the mass of laundry and a sley, which can be pivoted into the mass of laundry, further ensures that the upper pieces of the mass of laundry are partially held back, so that the mass of laundry is broken up to a large extent.

By further gradually moving the conveying device, the untangled and partially separated pieces of laundry are transferred to a transport device, such as a further conveyor belt, e.g., which connects to the device according to the invention at the output side and which ensures that the untangled and partially separated pieces of laundry are supplied to a further processing station. The untangled pieces of laundry can also be taken over and removed by a laundry cart or the like.

The level of the compressive forces acting on the mass of laundry is measured by means of suitable pressure medium sensors and is limited to predetermined maximum values. This keeps pieces of laundry from being damaged. In the event that the compressive forces acting on the mass of laundry or on the partially untangled pieces of laundry, respectively, exceed a maximum value, e.g. 10 bar, the untangled mass of laundry is released so as to keep the pieces of laundry from being damaged. However, it became evident that a suitable degree can be found rapidly for the compressive forces acting on the mass of laundry in response to a corresponding adjustment of the device according to the invention and in response to an adjustment to the mass of laundry, which is conveyed out of a press and which is always delivered in a certain form.

BRIEF DESCRIPTION OF THE DRAWINGS

Further features, advantages and details of the invention result from the following description of a preferred exemplary embodiment of the device according to the invention by means of the drawing.

DETAILED DESCRIPTION

Figure 1:
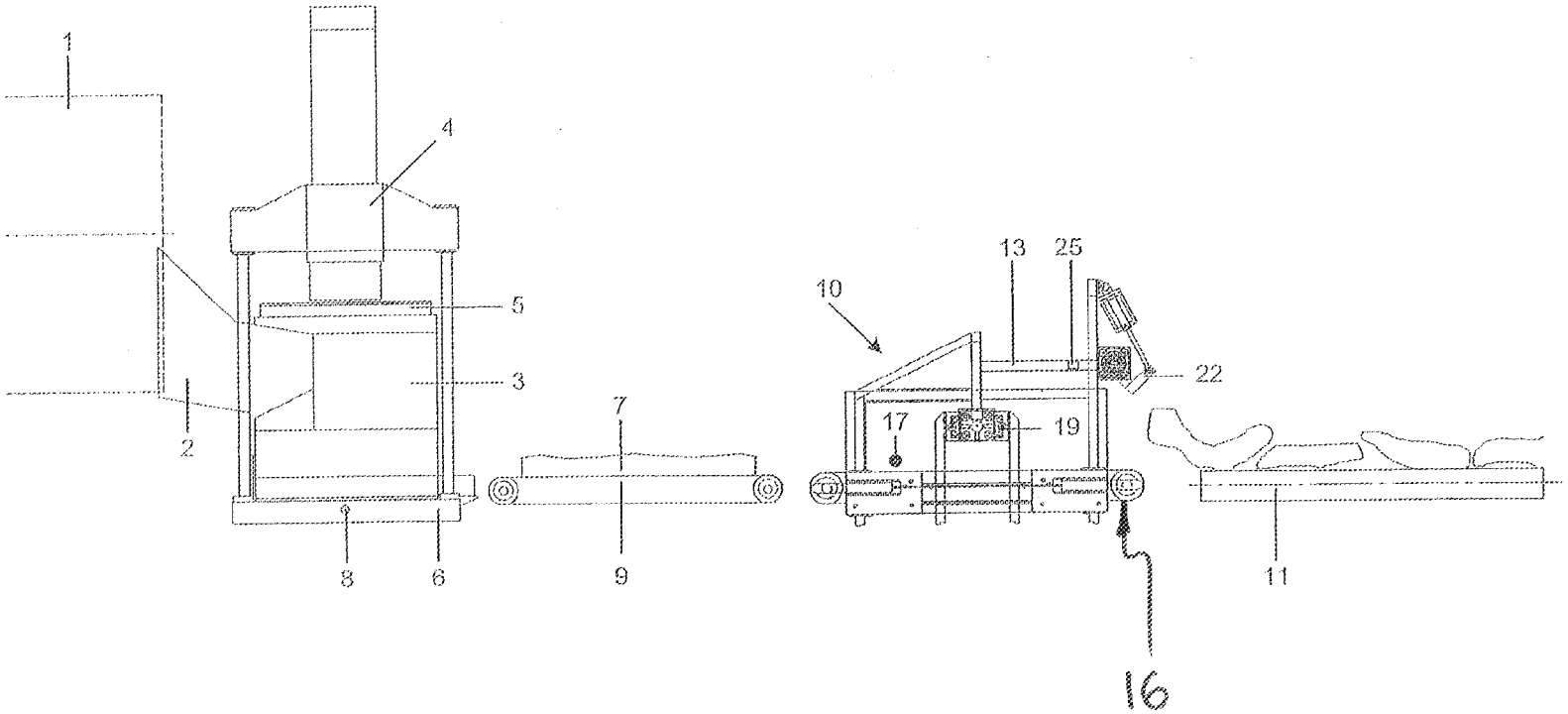
FIG. 1 shows a schematic illustration of a facility comprising a washing system, a press and a device according to the invention in a linked system.

FIG. 1 shows in a schematic manner the end of a washing system 1, a loading chute 2, via which washed laundry can reach from the washing system 1 into the press container 3 of the press 4. The press 4 encompasses a press ram 5, which can be displaced in the press container 3 and which presses the laundry against a press plate 6 to form a mass of laundry 7. The fluid in the laundry escapes at the lower end of the press plate at 8 and is introduced into a tank or is fed back to the washing system 1.

The mass of laundry 7 is discharged from the press 4 via a suitable conveying device and reaches the untangling device 10 according to the invention via a further conveyor belt 9 or directly (not illustrated) and is released onto a transverse conveyor belt 11 after the untangling, so as to be moved to a further processing station by means of said transverse conveyor belt 11.

Figure 2:
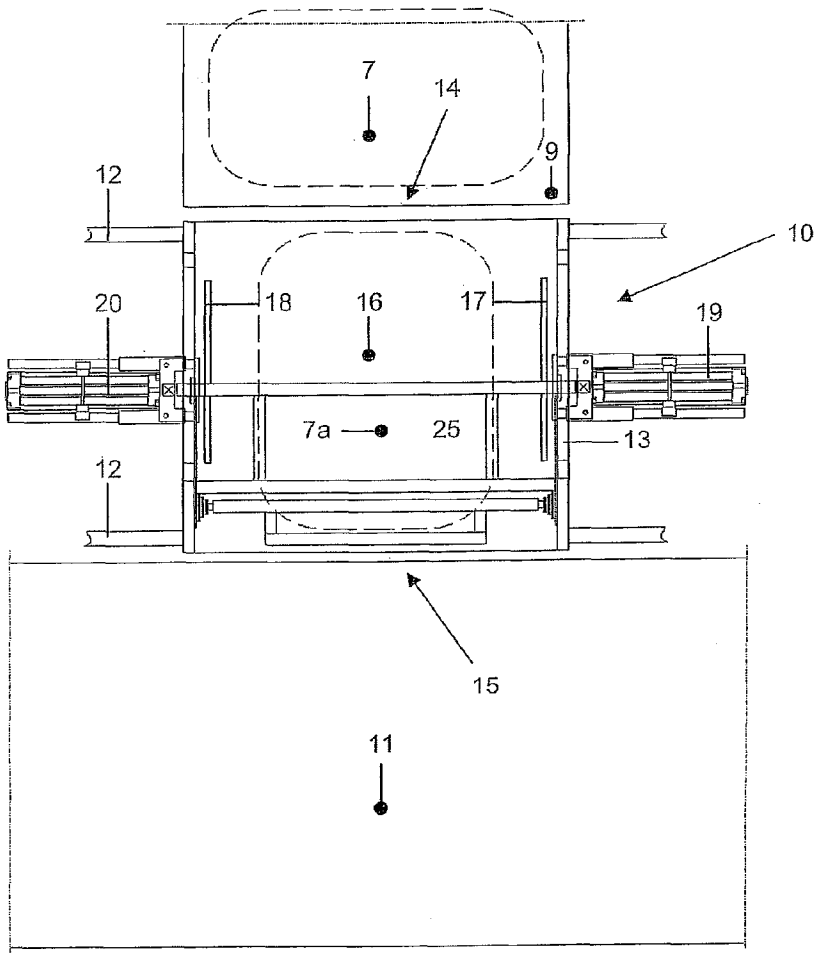
FIG. 2 shows a schematic top view onto the device according to the invention for untangling pieces of laundry of a mass of laundry.

FIG. 2 illustrates the device according to the invention in a top view. The device is supported on a rail system 12 so as to be laterally movable and can thus accommodate masses of laundry via conveyor belts 9, which are arranged next to one another and only one conveyor belt of which is illustrated, or directly from presses, which are arranged next to one another. Several presses, which are connected next to one another to corresponding washing systems, can thus be operated in an advantageous manner. Provision can also be made for a supplying conveyor belt to be laterally movable or for several conveyor belts to be arranged on top of one another and for the device according to the invention to be supported so as to be height-adjustable. It is important that the device according to the invention is used in a variable manner, so as to operate several presses.

Advantageously, the housing of the device according to the invention consists of a robust rack 13, which encompasses an open supply side 14 and an open discharge side 15. The bottom of the housing 13 is formed by a conveyor belt 16, on which the mass of laundry 7, which is conveyed by the conveyor belt 9, is placed. This bottom can be supported so as to be capable of being lowered or lifted, so as to be capable of accommodating masses of laundry of different heights. It is also possible for the housing to be capable of being lowered or lifted opposite to the bottom. The height measurement of the mass of laundry pulling in takes place by means of sensors, the signals of which are transmitted to a corresponding control device. This control device then prompts an adaptation of the device by lowering and/or lifting the conveyor belt 16 and/or the housing.

Figure 4:
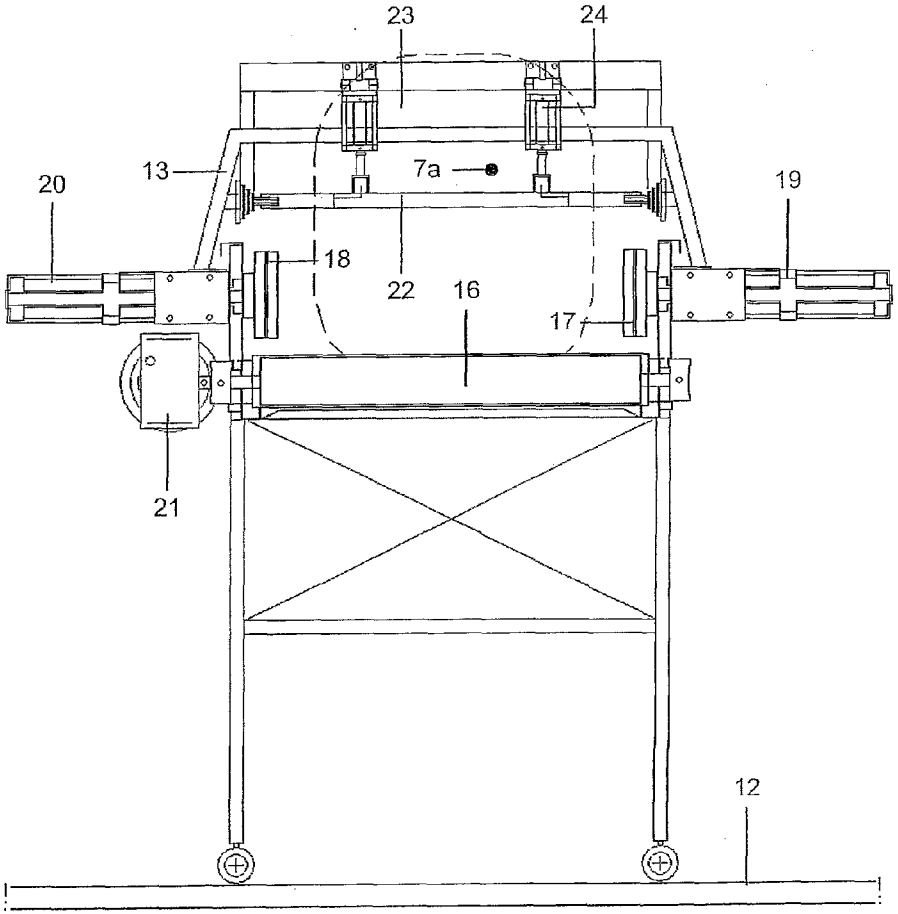
FIG. 4 shows a front view of the device according to the invention viewed from the discharge side with the sley in idle position.
Figure 3:
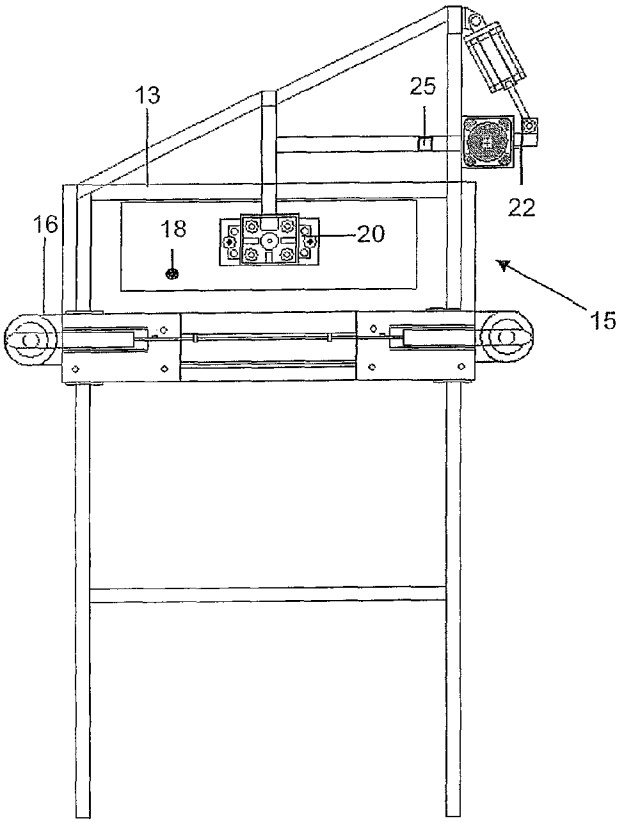
FIG. 3 shows a side view of the device according to the invention in idle position.
Figure 6:
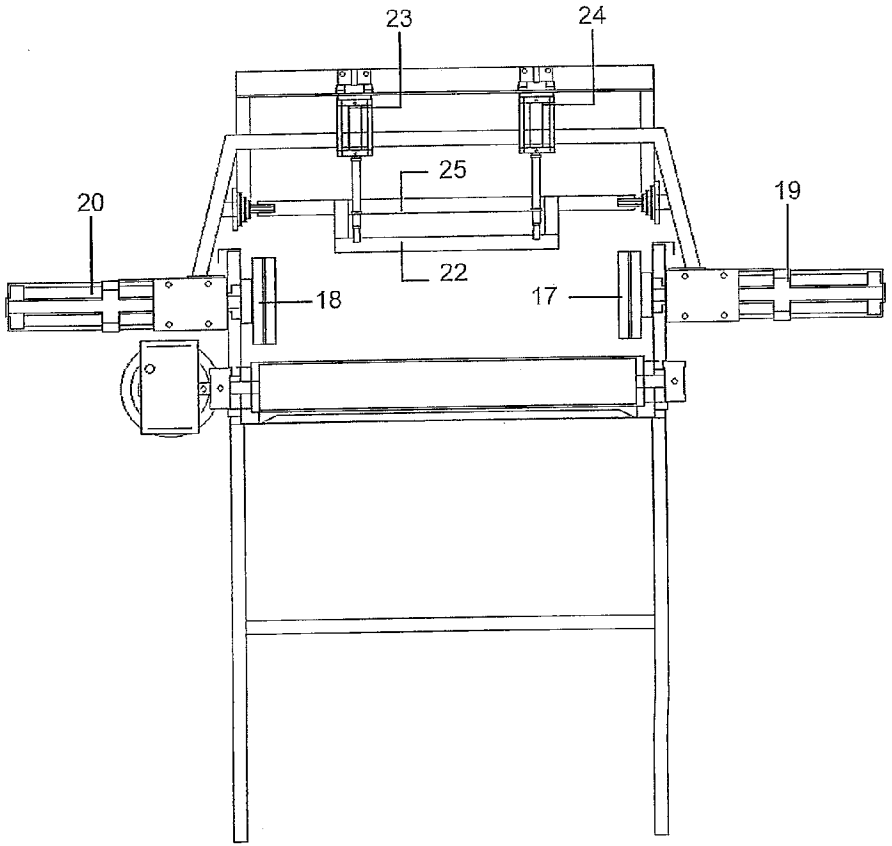
FIG. 6 shows a front view of the device according to the invention viewed from the discharge side with the sley in engaged position and FIG. 7 shows the impact of the device according to the invention on a mass of laundry as well as the further delivery of a further mass of laundry.

As can be seen in particular from FIG. 2, the side walls of the housing or of the rack 13, respectively, are formed by plate elements 17, 18. These plate elements 17, 18 form a deforming device, which—as can be seen in particular from FIG. 7—acts laterally on the mass of laundry 7. The plate elements 17, 18 are thereby embodied as shifting devices, which can be actuated by means of a pressure medium, wherein the pressure medium devices are formed by pressure medium cylinders 19, 20. Provision is made for an electric motor 21 (FIG. 4) for controlling the conveyor belt 16.

As can furthermore be seen from FIG. 2, provision is made on the discharge side 15 of the device according to the invention for a sley 22, which serves as output device and which extends across the entire width of the mass of laundry and which is supported on the rack 13 of the housing so as to be capable of being pivoted. This sley can be pivoted out of its horizontal position illustrated in FIG. 2 downwards into the trajectory of the mass of laundry 7 by means of pressure medium cylinders 23, 24, as it can clearly be seen from FIG. 5. The pressure medium cylinders 23, 24 are equipped with corresponding non-illustrated pressure medium delimiters, which prevent an excessive pressure to act on the upper side of the mass of laundry 7 and the pieces of laundry from thus being damaged, if applicable.

A stripping device 25 extending across the entire housing width is located upstream of the sley 22 in the conveying direction, which is indicated in FIG. 2 by means of the arrow. As can be seen from FIG. 7, said stripping device 25 acts on the upper side of the mass of laundry 7 in the event that the compressed and untangled mass of laundry is moved underneath the stripping device 25 and the pivoted sley 22 by means of the conveyor belt 16.

The conveyor belt 16 is roughened on its surface and encompasses additional profiling, so that it is ensured that the mass of laundry can be conveyed through the device according to the invention opposite to the compressive forces acting on it and that untangled, partially separated pieces of laundry can be transferred to the transverse conveyor belt 11.

Provision is made at the open supply side 14 and at the open discharge side 15 at the rack 13 of the device according to the invention for motion sensors, which are not illustrated in the drawing and which detect the conveying of the mass of laundry into the device and the discharge of the last separated untangled single pieces out of the device according to the invention onto the transverse belt 11 and which are integrated into the control of the device according to the invention.

The mass of laundry is untangled by means of repeated lateral pressing by means of the plate elements 17, 18, wherein the plate elements initially act on the front side of the mass of laundry and then on the center and on the rear side of the mass of laundry. Advantageously, the conveyor belt 16 is gradually moved forwards and backwards, so as to position the mass of laundry opposite to the lateral plate elements.

Figure 7:
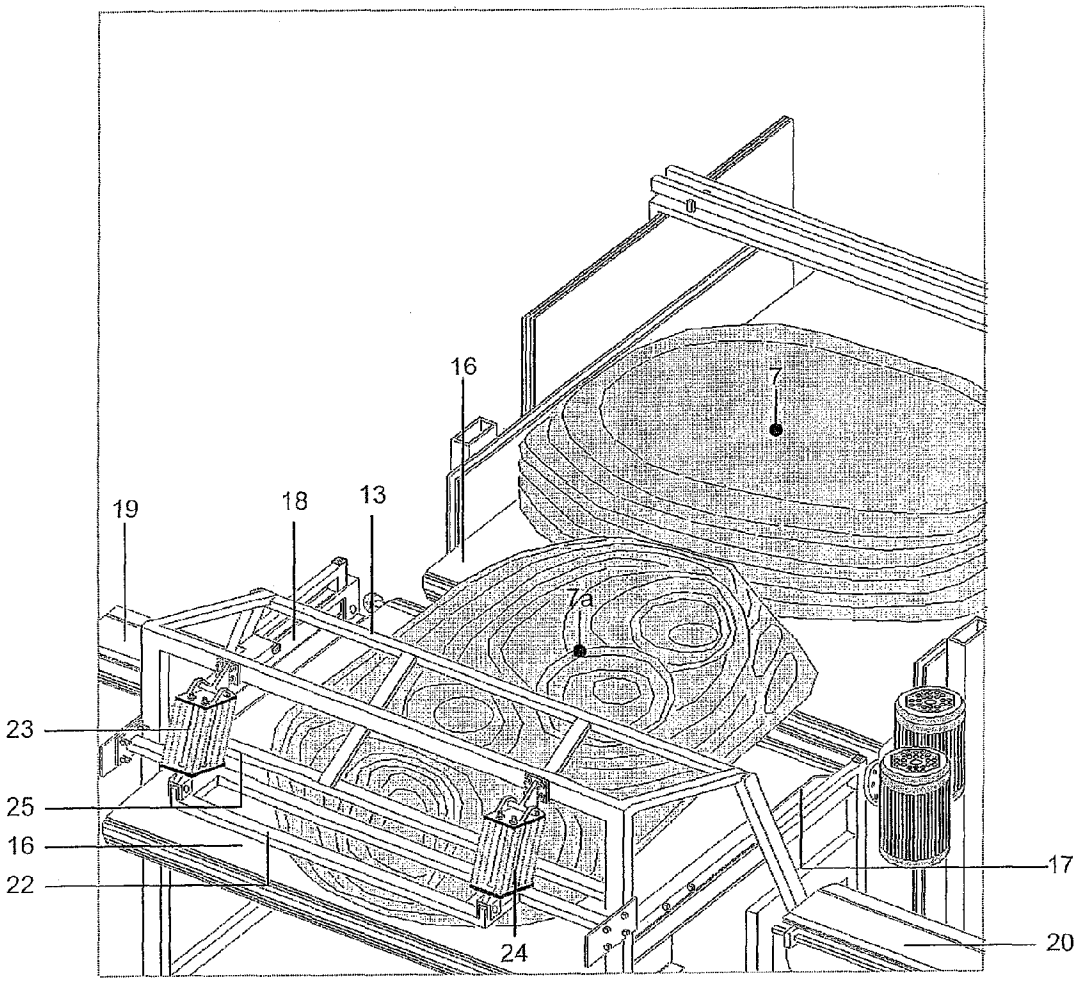

As can be seen from FIG. 7, this lateral pressing operation has already taken place in the case of the mass of laundry 7*a* and it can clearly be seen that this mass of laundry 7*a* is formed so as to be narrower than the subsequent mass of laundry 7 and that its height has been untangled.

Figure 5:
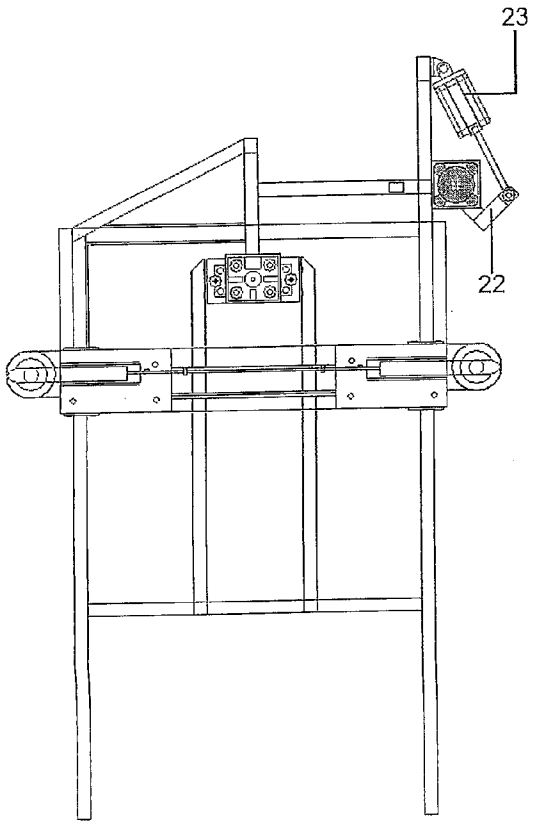
FIG. 5 shows a side view of the device according to the invention with the sley in engaged position.

Finally, it can be seen from FIG. 5 that the sley is pivoted downwards into the trajectory of the mass of laundry 7*a* by means of the pressure medium cylinders 23 and 24 and thus completely breaks up the mass of laundry before the untangled pieces of laundry are supplied to the subsequent transverse conveyor belt 11.

List of Reference Numerals

1 washing system
2 loading chute
3 press container
4 press
5 press ram
6 press plate
7, 7*a* mass of laundry
8 escape
9 conveyor belt
10 untangling device
11 transverse conveyor belt
12 rail system
13 housing, rack
14 supply side
15 discharge side
16 conveyor belt
17, 18 plate elements
19, 20 pressure medium cylinders
21 electric motor
22 sley
23, 24 pressure medium cylinders
25 stripping device

The invention claimed is

1. A device for untangling flat pieces of laundry, which are supplied in the form of a compact mass from a press connected downstream from a washing machine, comprising:

a housing, which accommodates the mass of laundry, having an assigned conveying device, a deforming device, which acts on the mass of laundry, and an output device that partially separates the pieces of laundry from the mass of laundry, the output device being separate from the deforming device, and the output device being disposed downstream of the deforming device in a conveying direction of the conveying device.

2. The device according to claim 1, wherein the housing includes a rack having an open supply side and an open discharge side.

3. The device according to claim 2, wherein a bottom of the housing is formed by the conveying device including a conveyor belt.

4. The device according to claim 3, wherein the conveyor belt connects the open supply side of the housing to the open discharge side.

5. The device according to claim 1, wherein the housing includes plate elements, the plate elements being arranged in a longitudinal direction of the conveying device.

6. The device according to claim 5, wherein the plate elements form the deforming device, and the plate elements are moveable at right angles to the conveying direction of the conveying device.

7. The device according to claim 1, wherein the plate elements are shifting elements, which can be actuated by a pressure medium.

8. The device according to claim 2, wherein the output device is arranged at the open discharge side of the housing and includes a sley, which extends at least across an entire width of the mass of laundry, and which can be moved into a trajectory of the mass of laundry.

9. The device according to claim 8, wherein the sley is pivotally supported on the rack.

10. The device according to claim 8, wherein the sley is actuated by a pressure medium.

11. The device according to claim 10, wherein the pressure medium includes pressure medium cylinders.

12. The device according to claim 11, wherein the pressure medium includes pressure medium delimiters for the pressure medium cylinders.

13. The device according to claim 8, wherein a height-adjustable stripping device is provided upstream of the sley in the conveying direction of the conveying device, the height-adjustable stripping device defining a passage level and extending across an entire width of the housing.

14. The device according to claim 11, wherein a bottom of the housing is formed by the conveying device, and an activation of the conveying device and the pressure medium cylinders is coordinated and program controlled.

15. The device according to claim 3, wherein the conveyor belt is gradually movable forwards and backwards.

16. The device according to claim 3, wherein the conveyor belt includes a surface having a high friction value, including a roughened and/or contoured surface.

17. The device according to claim 1, further comprising a conveyor belt system for delivering the mass of laundry and for removing the separated pieces of laundry.

18. The device according to claim 3, wherein the bottom formed by the conveyor belt can be lowered and/or lifted opposite to the housing or wherein the housing can be lowered and/or lifted opposite to the bottom.

19. The device according to claim 1, wherein the device is supported so as to be displaceable.

20. A method for untangling flat pieces of laundry using a device for untangling the flat pieces of laundry, the flat pieces of laundry being supplied in the form of a compact mass from a press connected downstream from a washing machine, the device for untangling the flat pieces of laundry including a housing, which accommodates the mass of laundry, having an assigned conveying device a deforming device, which acts on the mass of laundry, and an output device that partially separates the pieces of laundry from the mass of laundry, the output device being separate from the deforming device, and the output device being disposed downstream of the deforming device in a conveying direction of the conveying device, the method comprising:

mechanically untangling the mass of laundry by repeated lateral pressing;

mechanically moving the mass of laundry along the device;

gradually reducing a height of the mass of laundry; and placing the partially separated pieces of laundry onto a further conveying device.

21. The method according to claim 20, further comprising detecting the height of the mass of laundry using sensors and adapting the device to the height of the mass of laundry.

22. The method according to claim 20, wherein the mass of laundry is pressed together using plate elements, which act laterally thereon.

23. The method according to claim 20, wherein said mechanically moving the mass of laundry includes moving a conveyor belt forwards and backwards opposite to the plate elements.

24. The method according to claim 22, wherein a front lateral part of the mass of laundry is pressed together and then a rear lateral part of the mass of laundry is pressed together by the plate elements, which are actuated by a pressure medium.

25. The method according to claim 22, wherein a pressing speed of the plate elements is variable.

26. The method according to claim 20, wherein an upper side of the mass of laundry is processed after the lateral untangling, while the mass of laundry gradually moves forward in the conveying direction.

27. The method according to claim 20, wherein a level of compressive forces acting on the mass of laundry is measured and is limited to predetermined maximum values.

28. The method according to claim 20, wherein the mass of laundry or the partially separated pieces of laundry, respectively, are released to be removed in response to exceeding a maximum compressive stress of 10 bar.

* * * * *